US005740961A

United States Patent [19]

Bruning

[11] Patent Number: 5,740,961

[45] Date of Patent: Apr. 21, 1998

[54] RAILWAY CROSSING INSTALLATION

[76] Inventor: William E. Bruning, 13826 Pierce St., Omaha, Nebr. 68144

[21] Appl. No.: 613,213

[22] Filed: Mar. 8, 1996

[51] Int. Cl.[6] ..... E01C 9/04

[52] U.S. Cl. ..... 238/8

[58] Field of Search ..... 238/2, 6, 7, 8, 238/9

[56] References Cited

U.S. PATENT DOCUMENTS

| | | | |
|---|---|---|---|
| 2,081,352 | 5/1937 | Brown | 238/8 |
| 2,574,926 | 11/1951 | Manley | 238/8 |
| 2,835,451 | 5/1958 | Goulding, Jr. | 238/8 |
| 2,950,057 | 8/1960 | Speer | 238/8 |
| 3,341,123 | 9/1967 | Holthausen | 238/8 |
| 3,353,747 | 11/1967 | Speer | 238/8 |
| 3,469,783 | 9/1969 | Uralli et al. | 238/8 |
| 3,825,184 | 7/1974 | Hartl | 238/8 |
| 3,955,761 | 5/1976 | Szarka et al. | 238/8 |
| 4,147,304 | 4/1979 | Blyton | 238/8 |
| 4,203,547 | 5/1980 | van der Harst | 238/8 |
| 4,236,670 | 12/1980 | Limmergard et al. | 238/8 |
| 4,336,906 | 6/1982 | Limmergard | 238/8 |
| 4,415,120 | 11/1983 | Thim | 238/8 |
| 4,449,666 | 5/1984 | Hales et al. | 238/84 |
| 4,457,468 | 7/1984 | Hales et al. | 238/8 |
| 4,461,421 | 7/1984 | Maass | 238/8 |
| 4,606,498 | 8/1986 | Grant et al. | 238/8 |
| 4,641,779 | 2/1987 | O'Brien et al. | 238/7 |
| 4,793,545 | 12/1988 | Raymond | 238/8 |
| 4,860,952 | 8/1989 | Schmidt | 238/8 |
| 4,871,809 | 10/1989 | Szarka . | |
| 4,880,158 | 11/1989 | Cook | 238/8 |
| 4,899,933 | 2/1990 | Martin | 238/8 |
| 4,911,360 | 3/1990 | Spurr | 238/5 |
| 5,181,657 | 1/1993 | Davis | 238/8 |
| 5,210,467 | 5/1993 | Kennel et al. | 238/8 |
| 5,282,569 | 2/1994 | Kiyota | 238/8 |
| 5,609,294 | 3/1997 | Lucas, Jr. | 238/8 |

*Primary Examiner*—S. Joseph Morano
*Attorney, Agent, or Firm*—Tilton, Fallon, Lungmus & Chestnut

[57] ABSTRACT

A railway crossing installation for a pair of spaced apart elongated rails each having in transverse section a bottom horizontal flange, a vertically extending bight and a top ball. A plurality of relatively elongated concrete panels are provided, with each panel having a top surface generally aligned with the ball upper surface, each panel having elongated sides disposed adjacent the rails and ends disposed in confronting relation to any adjacent panels. The panel side adjacent a rail has an integral elongated projection spaced below the panel top surface, with the projection extending toward the bight and having a vertical side spaced from the bight. A resilient, elongated extrusion extends along each panel side between the projection side and the rail bight, the extrusion having a body part compressively stressed between a ball lower surface and a projection side, the body part when unstressed overlying the projection.

18 Claims, 6 Drawing Sheets

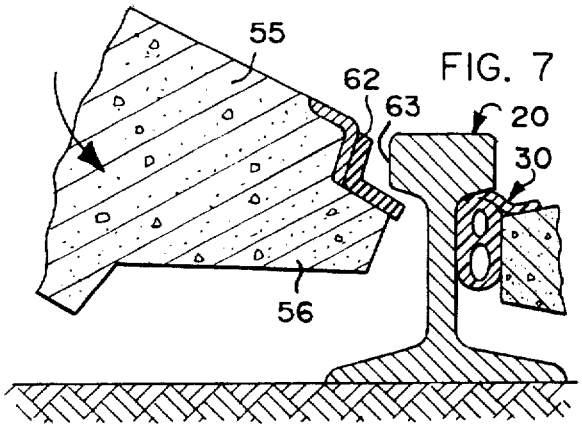
FIG. 7
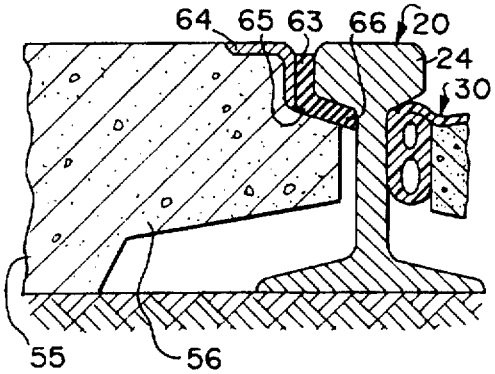
FIG. 8
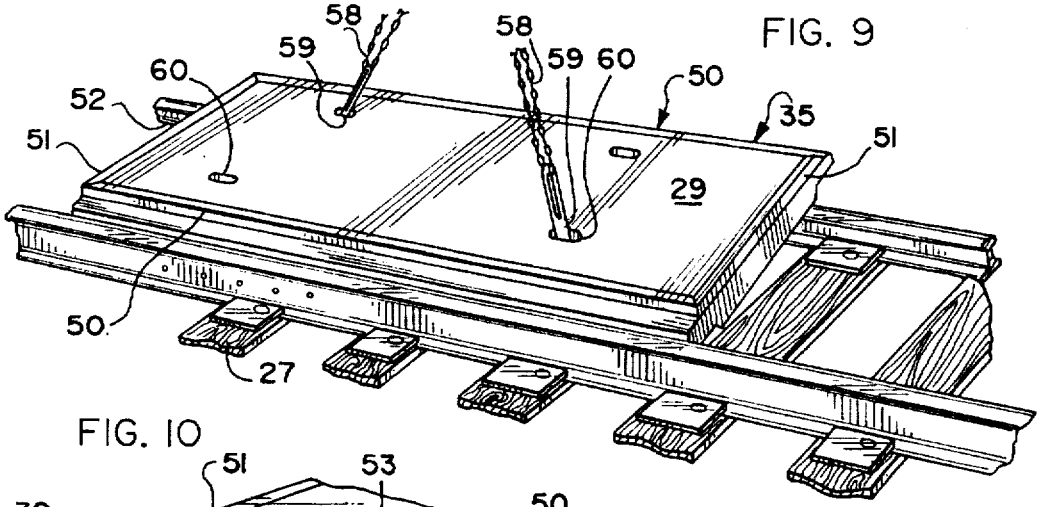
FIG. 9
FIG. 10
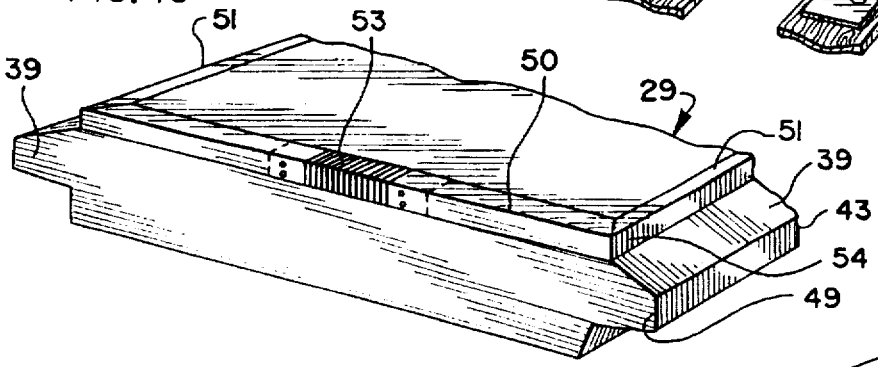
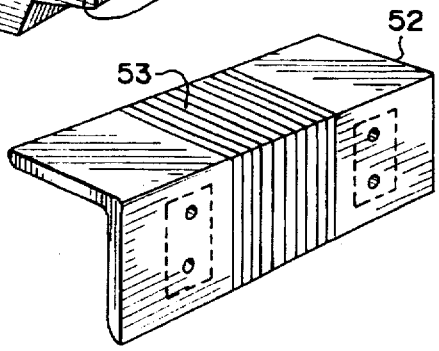
FIG. 11

FIG. 15
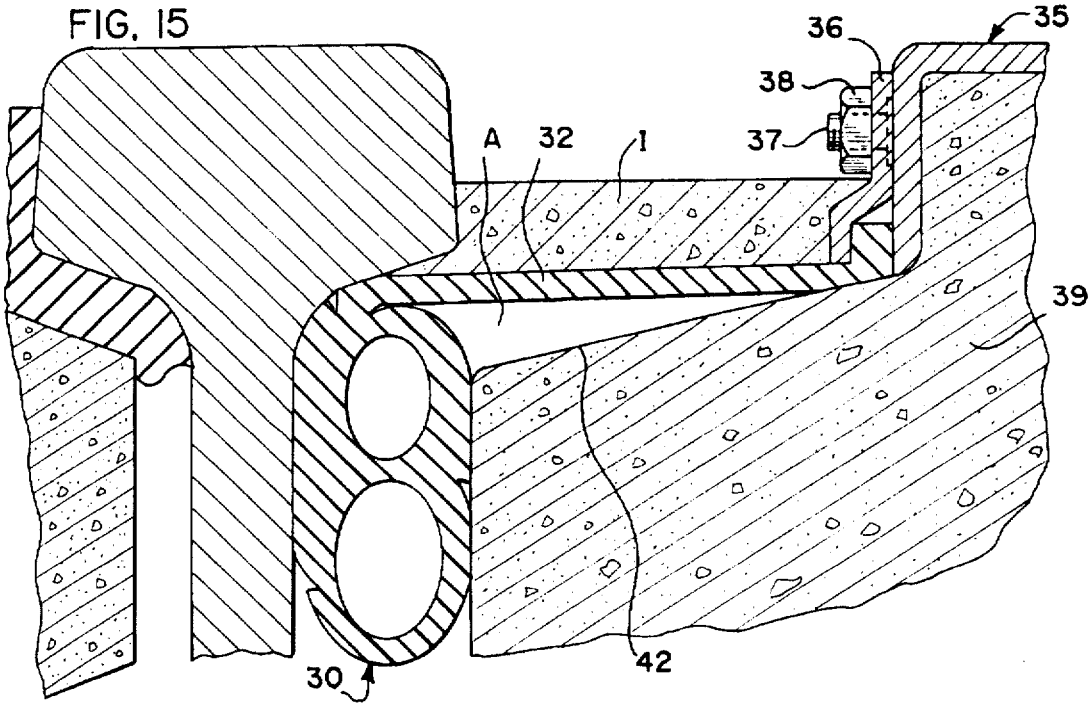
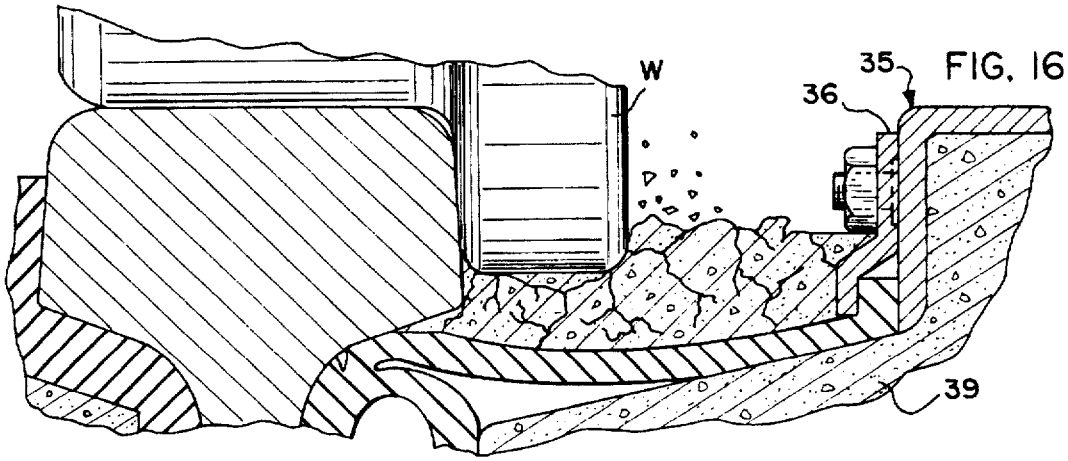
FIG. 16
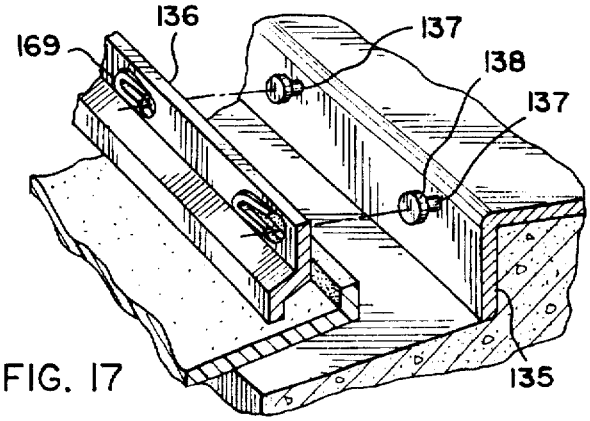
FIG. 17
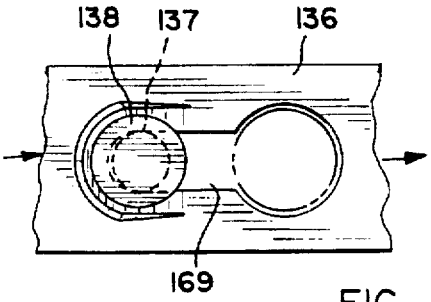
FIG. 18

RAILWAY CROSSING INSTALLATION

BACKGROUND AND SUMMARY OF INVENTION

This invention relates to a railway crossing installation and method and, more particularly, to an arrangement and construction of elastomeric extrusions and concrete panels for crossings.

For years, railroads have built up the spaces between rails and the areas beside the rails to achieve level crossings. And, also over the years, a wide variety of constructions have been suggested, particularly those that conform to the lateral profile of the rails. For example, in the U.S. disclosure of installation of elongate elastomeric pads and non-elastomeric panels is seen in U.S. Pat. No. 5,181,657. Earlier disclosures in U.S. patents include rigid material between rails and a deformable resilient cushion between the rigid material and the rails, as in U.S. Pat. No. 2,835,451. Other deformable cushioning members are disclosed in U.S. Pat. Nos. 3,469,783, 4,461,421 and 4,606,498. Other shaped resilient filler strips are seen in U.S. Pat. Nos. 2,950,057, 3,353,747, 4,449,666, 4,457,468, 4,793,545, 4,871,809, 4,899,933, and 5,201,467. A tar filler between the rails and panels of German origin is seen in U.S. Pat. No. 3,341,123. A C-shaped resilient filler strip of Austrian origin is seen in U.S. Pat. No. 3,825,184. One of Dutch origin is seen in U.S. Pat. No. 4,203,547. One of Swedish origin is seen in U.S. Pat. Nos. 4,236,670, 4,336,906 and 4,415,120. A rubber covered installation of Japanese origin is seen in U.S. Pat. No. 5,282,569.

In my invention, a crossing installation includes at least one concrete panel between (and others which may flank) a pair of spaced apart elongated rails. In conventional fashion, each rail in transverse section has a bottom horizontal flange, a vertically extending bight and a top ball with the ball having an upper surface and also a lower surface with the lower surface being in two parts flanking the bight. Of particular concern in the art is the roadway space between the two rails making up a track and, for that matter, between the inboard rails of a two track system. The invention can also be used to advantage adjacent the outboard rails, if desired.

These panels each have a top surface generally aligned with the ball upper surface and some additional panels, if used, having elongated sides disposed adjacent the panels and also having ends disposed in confronting relation to adjacent panels. Each panel side adjacent the rail has an integral elongated projection spaced below the panel top surface and with each projection extending toward the bight and having a vertical side spaced from the bight. The invention further includes a resilient extrusion extending along each panel side between the projection side and the rail bight with the extrusion having an integral portion compressibly stressed between a ball lower surface and a projection side with the integral portion when unstressed overlying the projection.

Advantageously, the resilient extrusion is constructed of a synthetic rubber which is possessed of a memory so that when installed, the extrusion attempts to return to original configuration and thereby effects a reliable and continuing seal between the concrete panel and the adjacent rail.

In addition to providing an especially advantageous seal in the area where the wheel flange projects, the invention has the advantages of ease of installation, lower cost, ease of replacement, etc.

BRIEF DESCRIPTION OF DRAWING

The invention is described in conjunction with the accompanying drawing, in which

FIG. 7 is a schematic sectional view showing how the roadway panels are installed on both sides of a rail and with FIG. 7 representing an initial stage of the installation of the approach panel outside of a rail;

FIG. 8 is a view similar to FIG. 7 but with the approach panel rotated to its installed position on the outboard side of the rail;

FIG. 9 is a fragmentary perspective view of a concrete panel embodying teachings of the invention shown in the process of being installed between a pair of rails;

FIG. 10 is a fragmentary end perspective view of the panel seen in FIG. 9 and showing the interruption of the perimetric angle so as to preclude flow of current readily between the adjacent rails;

FIG. 11 is an enlarged fragmentary view of the central portion of FIG. 10;

FIG. 15 is a fragmentary sectional view similar to the showing in FIG. 6 but showing a possible ice buildup between the rail and the gauge panel;

FIG. 16 is a view similar to FIG. 15 but showing the effect on the ice buildup of the railway car wheel flange;

FIG. 17 is a fragmentary exploded perspective view showing an alternative means for clamping the foot of the extrusion to the concrete panel; and FIG. 18 is an enlarged fragmentary elevational view of a portion of FIG. 17 showing the installed assembly of the stud and keyhole shaped opening in the stepped clamping bar.

DESCRIPTION OF PRIOR ART

Figure 1:
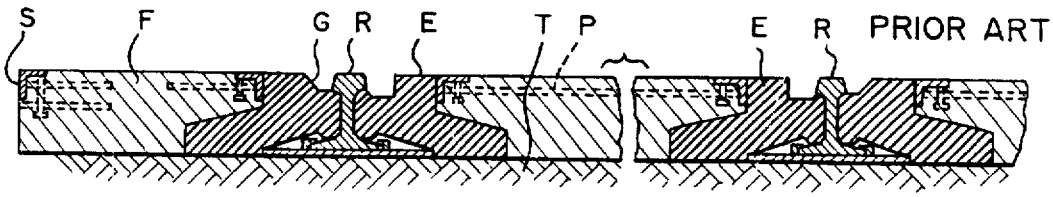
FIG. 1 PRIOR ART
FIG. 1 is a fragmentary cross sectional view of a prior art installation such as is seen in U.S. Pat. No. 5,181,657.

The prior art is exemplified by U.S. Pat. No. 5,181,657 and illustrated in FIG. 1. There, a pair of rails R are seen to be mounted on ties T with the space between the rails occupied principally by a concrete panel or panels P and elastomeric units E. The elastomeric units E are urged into contact with the rails 10 to prevent water seepage below the crossing where it could cause degradation of the road bed that supports the ties. As indicated previously, the combination of elastomeric and non-elastomeric elements for railroad crossing is well known, going back quite a number of years. The center line to center line between tracks for standard gauge is 59½". Current practice is to allow at least 1¾" spacing between the concrete panel and the inboard edge of the rail ball for passage of the wheel flange. Normal practice is to increase this to about 2¾". Thus, a typical width of concrete panel is 4'3". The field panels, i.e., those as at F which are outboard of the rails in a single track installation as depicted in FIG. 1, are normally about 2' wide or more and again there is a suitable gap to be filled between the adjacent end of the field panel and the rail as at G. However, all that is required there is a seal inasmuch as the wheel flange is on the inboard side of the rail R.

DETAILED DESCRIPTION OF INVENTION

Figure 2:
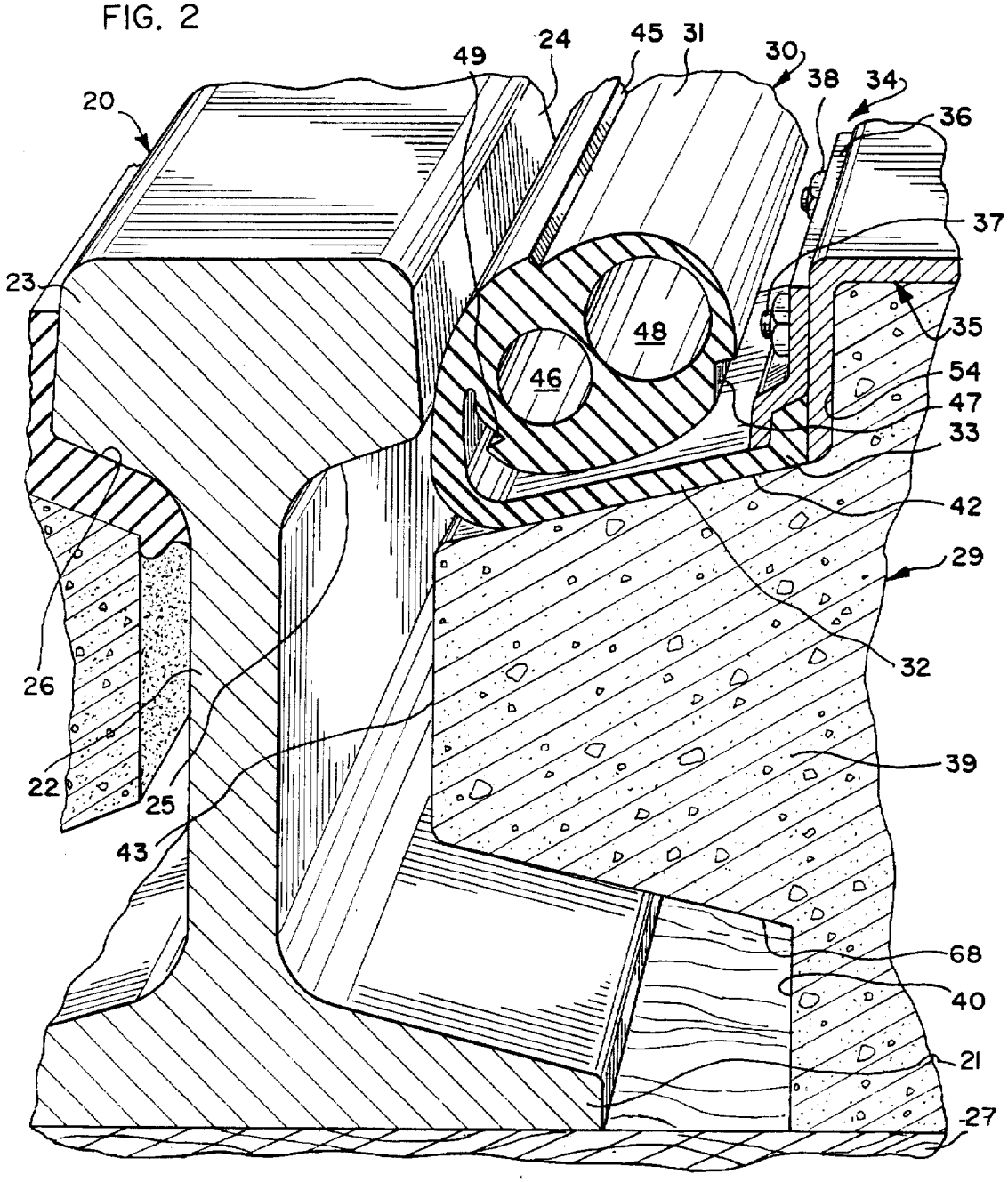
FIG. 2 is an enlarged fragmentary sectional view of the inventive installation showing both the extrusion and a portion of the concrete panel as heretofore discussed.

The invention can be quickly appreciated first from a consideration of FIG. 2 and then the sequence views of FIGS. 3–6.

Turning first to FIG. 2, the numeral 20 designates generally a conventional rail which has a base 21 and a vertically extending wall or thinner portion 22 which is essentially a "bight" to connect the base 21 with the ball 23. The rail is, of course, symmetrical about a vertical center plane and, in the illustration given, the flange of the railroad wheel (not shown) would depend along the side 24 of the ball 23. The ball 23 has an undersurface interrupted by the bight 22 and thereby providing flanking lower surfaces 25 and 26.

Figure 12:
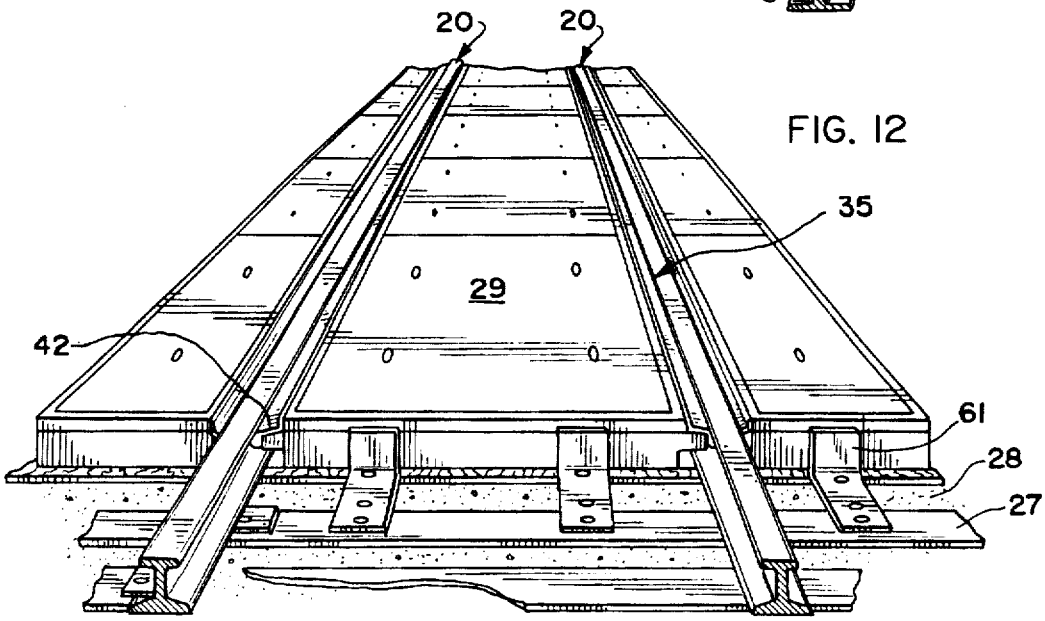
FIG. 12 is a fragmentary perspective view of an intermediate stage of installation showing the central and field or approach panels installed with the ends of the outer panels being clipped in position by angle clips.

The base 21 of the rail 20 rests upon a tie 27—see also FIG. 12—which in turn is supported by the road bed 28. Still referring to FIG. 12, the numeral 29 designates generally one of a plurality of identical concrete panels which are shown disposed between the rails 20.

Now returning to FIG. 2 where the installation is seen in larger scale, the numeral 29 again designates the concrete panel which is seen only in fragmentary form and this is associated with an extrusion or filler generally designated 30—for filling the gap between the concrete panel 29 and the rail 20.

The extrusion 30 is relatively elongated and can be provided in lengths of 10 feet or so in the form depicted in FIG. 2 and 12. In FIG. 2, a body part 31 overlies a tail part 32 with the two parts being integral as illustrated. The tail part at its end opposite to the end connected to the body part is equipped with a foot 33. The foot 33 is seen to be clamped by the clamping means generally designated 34 against the upper part of the concrete panel 29.

More particularly, the concrete panel 29 has a perimeter framed with steel angle iron as at 35. This is a known procedure for preventing crumbling of the concrete edges due to automobile impact and the like. However, I put the angle framing to an additional advantageous use. It provides an anchor for the clamping means 34. The releasable nut and bolt means 34 includes a stepped bar 36 and fasteners 37 for urging the bar 36 against the angle framing generally designated 35 to clamp the foot 33 immovably, but releasably in place. The angle framing 35 can be equipped with releasable bolt means 37 for the purpose of securing the clamping bar 36 by nuts 38. The bolt means can be, for example, threaded studs welded to the angle frame 35.

As shown in FIG. 2, the extrusion 30 is "unstressed", i.e., in the form it assumes when issuing from the extruder. A wide variety of elastomeric materials may be employed as the material of construction of the extrusion 30 but I prefer to use EP rubber, i.e., ethylene propylene rubber having the ASTM SAE designation Type R.

Figure 6:
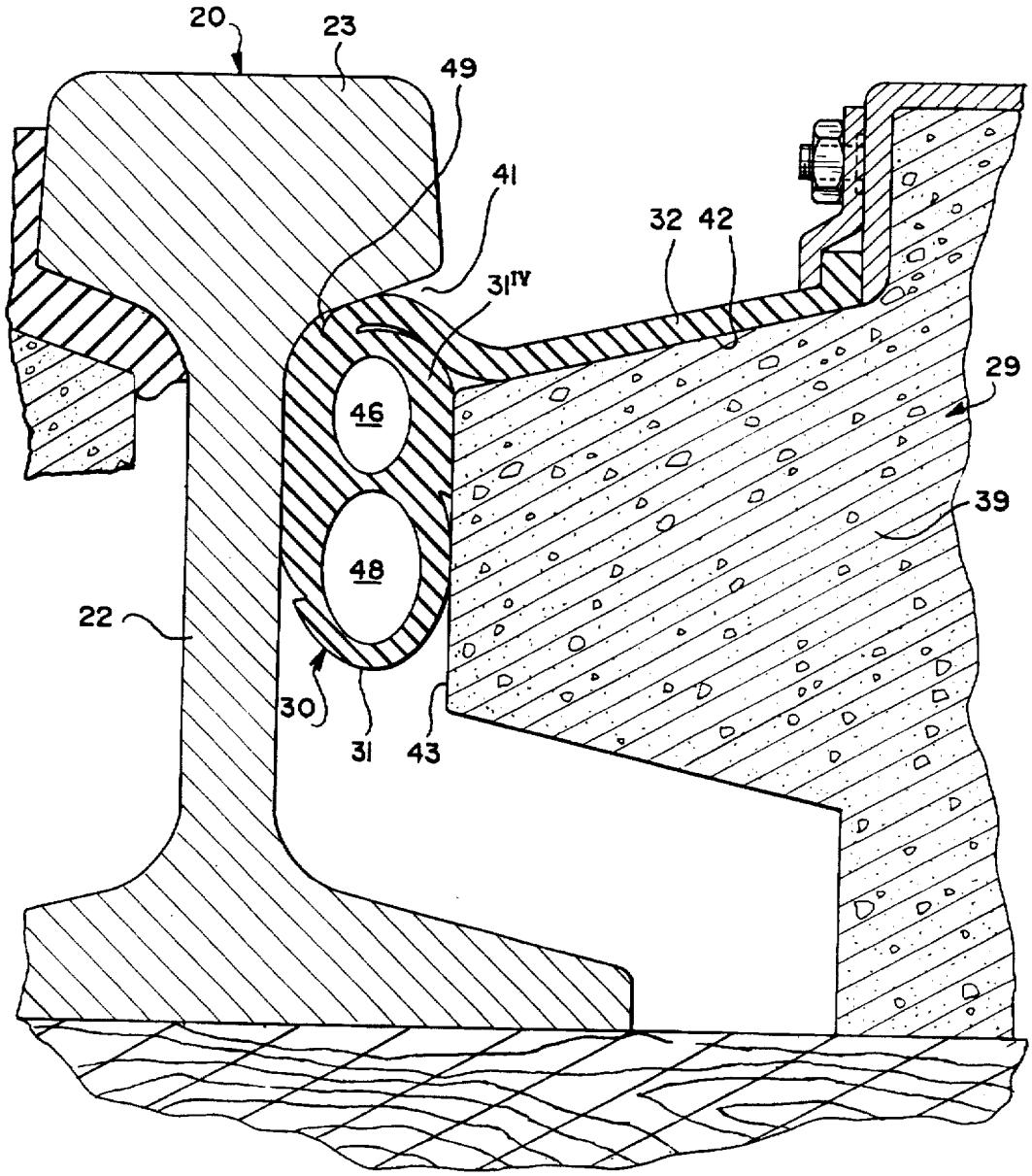
FIG. 6 is a view similar to FIGS. 3–5 but showing the extrusion in its final orientation or position as an effective seal between the concrete panel and the rail.

As seen in FIG. 2, the body part 31 and the tail part 30 are superposed, viz., the body part 31 resting on top of the tail part 32. In turn, the tail part 32 is supported on a projection 39 provided in the panel 29. The projection 39 is intermediate the top and bottom of the panel 29 and projects outwardly from a sidewall 40. The upper sidewall, i.e., the portion of the sidewall above the projection 39 is that which is framed by the framing member 35. It will be noted that the projection 29 is suitably below the rail ball 24 and, more especially, below the undersurface 25 of the ball 23. This develops a throat 41 which is best seen in FIG. 6. In FIG. 6, the final installation is depicted where the tail part 32 still is positioned on the upper surface 42 of the projection 39 but wherein the body part $31^{IV}$ is now under compressive stress between the side face 43 of the projection 29 and the undersurface 25 of the ball 23 and the bight 22.

Figure 3:
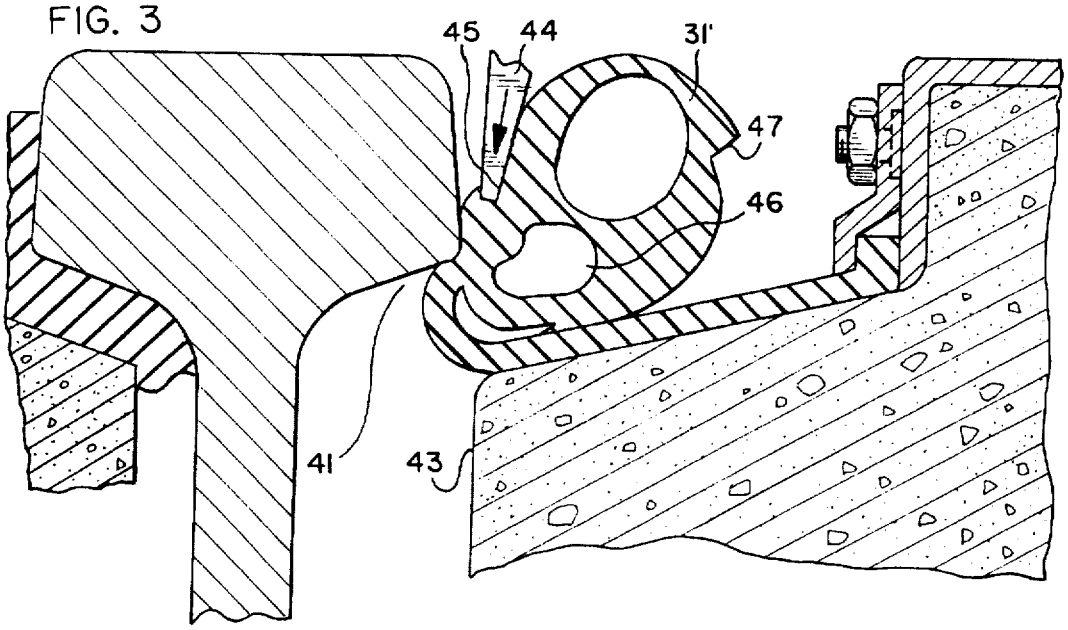
FIG. 3 is a view similar to FIG. 2 but showing the extrusion in a later stage of installation between a panel and a rail, both shown fragmentarily.
Figure 4:
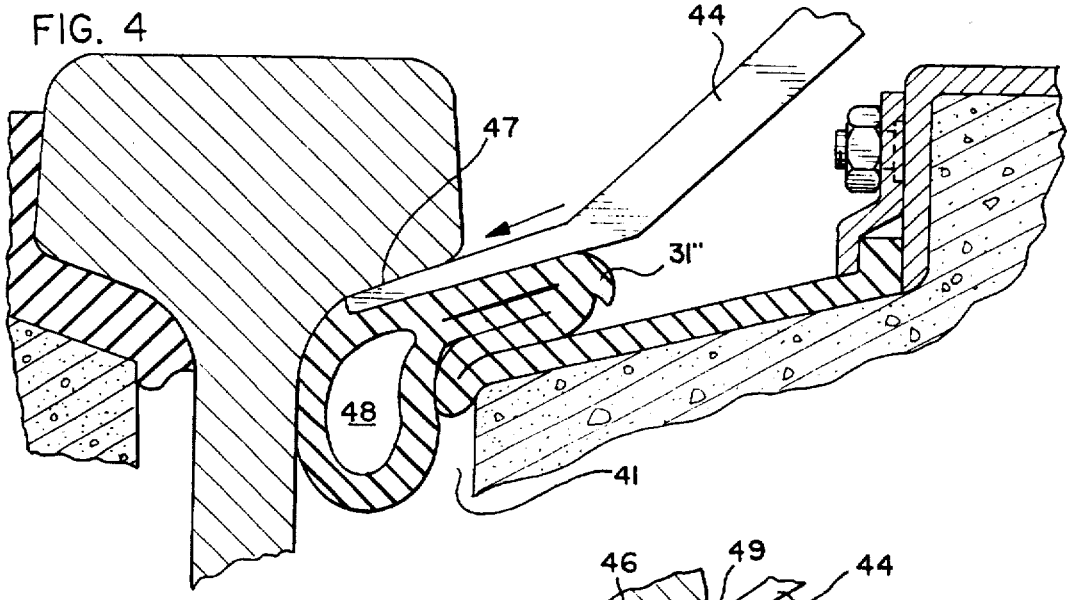
FIG. 4 is a view similar to FIG. 3 but of a still further stage of development of the installation wherein the body part which normally overlies a tail part when the body part is unstressed as in FIG. 2 is further rotated toward its final stressed condition.
Figure 5:
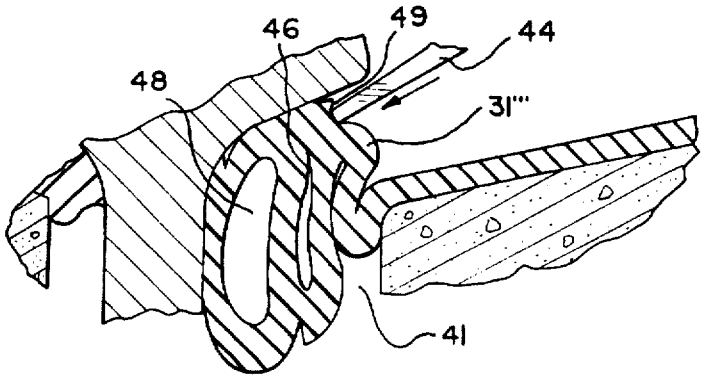
FIG. 5 is a view similar to FIG. 4 but showing the extrusion in a subsequent stage of installation but still prior the final installation.

The progress of the body part 31 from its unstressed showing in FIG. 2 to its stressed condition of FIG. 6 can be appreciated from a consideration of FIGS. 3–5.

Installation of Body Part

Referring now to FIG. 3, it will be seen that the body part now designated 31' has been partially moved into the throat 41 by virtue of a downward force applied by a pinch bar (shown schematically as at 44).

To implement this operation, I provide a plurality of notches, one of which is designated 45 in FIG. 3. The pinch bar is seen seated in the notch 45 and starting to roll the body part 31' into the throat 41. Also to be noted in FIG. 3 is the distortion of a smaller opening 46—compare the left hand opening in FIG. 2.

As the body part 31' is pushed further and further through the throat 41, there is no longer a purchase or prying means available through the notch 45 and the railroad worker shifts the pinch bar 44 to the position seen in FIG. 4 where it engages a notch 47—also designated in FIG. 3. It will be seen that the notch 45 (see FIG. 2) is located approximately between the transversely extending openings 46 and 48. The next notch in line (of operation) is designated 47 and that is seen to be adjacent the larger opening 48. By exerting downward pressure on the body part 31"—as seen in FIG. 4, the body part is rolled on itself so now the portion of the body part adjacent the larger opening 48 has effectively passed through the throat 41.

The next intermediate stage shows the body part still further compressed as at 31'" where now the larger opening 48 is further collapsed and the smaller opening 45 is still substantially collapsed.

The last stage of installation through the throat 41 is seen in the previously described FIG. 6 and now we see the openings 48 and 46 being essentially elliptical but still under compressive stress. This has been brought about through the action illustrated in FIG. 5 where the pinch bar 44 is operating against a third notch 49 which in the unstressed condition can be seen in the left center of FIG. 2. Applying forcing pressure on the notch 49 as seen in FIG. 5 results in the displacement of the notch slightly further into the throat 41 as seen in FIG. 6.

Although openings in fillers—somewhat similar to those at 46 and 48—are normally provided to permit compression by the passage of the wheel flanges as in U.S. Pat. No. 3,469,783, they do not stay under continuous compression—as is the case with the present invention. With the present invention, the memory retained in the extrusion 30 effects a strong seal between the sidewardly facing face 43 of the projection 39 and the undersurface 25 of the ball 23 and the bight 22.

SUMMARY OF THE INVENTION

First focusing on the extrusion 30 it is a unitary elongated member constructed of elastomeric material which possesses a memory tending to cause the stressed shape to return to its unstressed, extruded condition. The extrusion has a body part 31 and a tail part 32. A satisfactory elastomeric material is 60 Durometer EP rubber with the EP referring to ethylene propylene. It has been employed for outdoor application because of resistance to ozone, oxidants and severe weather conditions. However, other rubber and rubber-like materials may be used to advantage, very often depending upon the price structure.

The body part is equipped with a plurality of notch means as at 45, 47 and 49 and in each case there is a pronounced "step" or a generally radially extending surface suited for engagement by the end of a pinch bar—see FIGS. 3–5.

The body part is also equipped with a larger opening 48 and a smaller opening 46 each of which extend longitudinally relative to the elongated extrusion 30. The openings 46, 48 become at least partially collapsed incident to the compressive introduction of the body part into the space defined by the bight 22, the undersurface 25 of the ball and the vertical wall 43 of the projection 39. The distortion can be appreciated from a comparison of FIGS. 2 and 6. In FIG. 6, the extrusion has assumed a generally P shape with the tail part 32 constituting the stroke of the P shape and the body part 30 constituting the loop of the P shape.

The panel 29 has as its basic material of construction concrete and, as illustrated particularly in FIG. 12 is a rectangular solid. The solid is framed about its upper surface by a perimeter of 2"×2" angle steel 35 (still referring to FIG. 12). Now referring to FIG. 9, the frame 35 is seen to include longitudinally extending members 50 and transversely extending members 51. The members 51 are interrupted as at 52 (see especially FIG. 9) to provide a blockage for electrical current which might travel from one rail to the other. To avoid that possibility, I insert a block or section of plastic material as at 53 in FIG. 11 which is of high electrical resistance to prevent the inadvertent short circuiting of the rails.

As can be readily appreciated from a consideration of FIG. 10, the longitudinal sides of the panel 29 are equipped with projections 39 which are spaced somewhat below the top surface of the panel (compare FIGS. 2 and 10). Likewise, the projection 39 is spaced above the bottom of the panel so that there are discrete sidewall portions 54 and 55 in the panel 29. As mentioned previously, there is a sidewall 43 provided on the projection 39 which is operative to confine the body part 31—see particularly FIG. 6. As indicated above, there is about a 2¾" spacing between the inboard edge of the rail ball 23 and the adjacent edge of the panel 29. Inasmuch as the vertical surface 43 of the projection 39 is approximately aligned with the inboard edge of the rail 23—see FIG. 6—the horizontal dimension of the projection 39 is about 2¾".

I find it advantageous to equip the field or outboard panel 55 with the same projection as at 56—see FIGS. 7 and 8. Normally, field panels have widths of the order of about 2' or slightly more. A typical installation has the field panel equipped with only one projection—on the side adjacent the rail, the remote side being squared as at S at the left end of FIG. 1. So, if standardization is desired, two panels, each with confronting butt ends could be substituted for the single central panel 29.

Still further, concrete panels are made in lengths of about 10' and then joined end-to-end as by spot welding to achieve the necessary span for the width of the roadway. The lengths of extrusion 30 necessary for the span are advantageously butt connected (end-to-end) through flexible adhesive patches 57—see the center right portion of FIG. 14.

Installation

Figure 13:
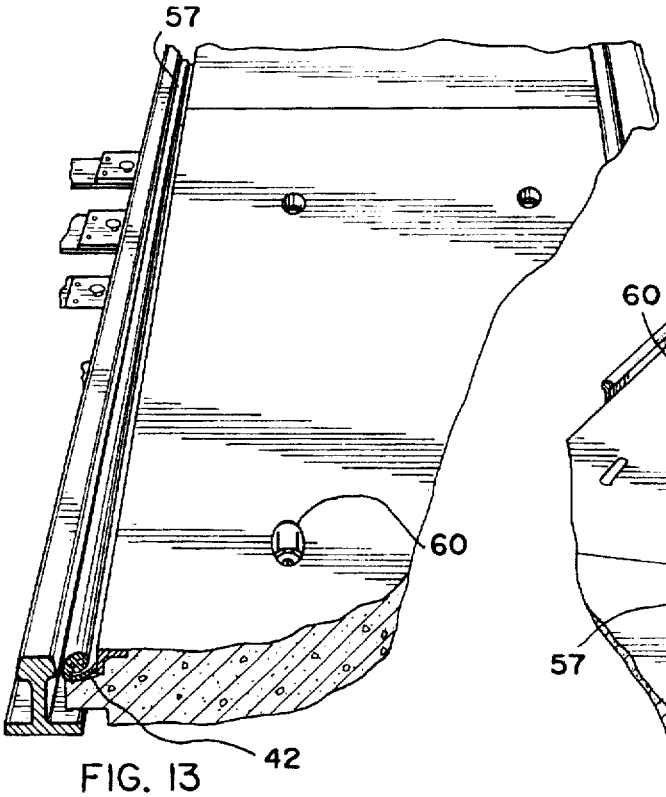
FIG. 13 is a fragmentary top perspective view of a pair of rails with concrete panels installed there between and with the extrusion shown before being installed.
Figure 14:
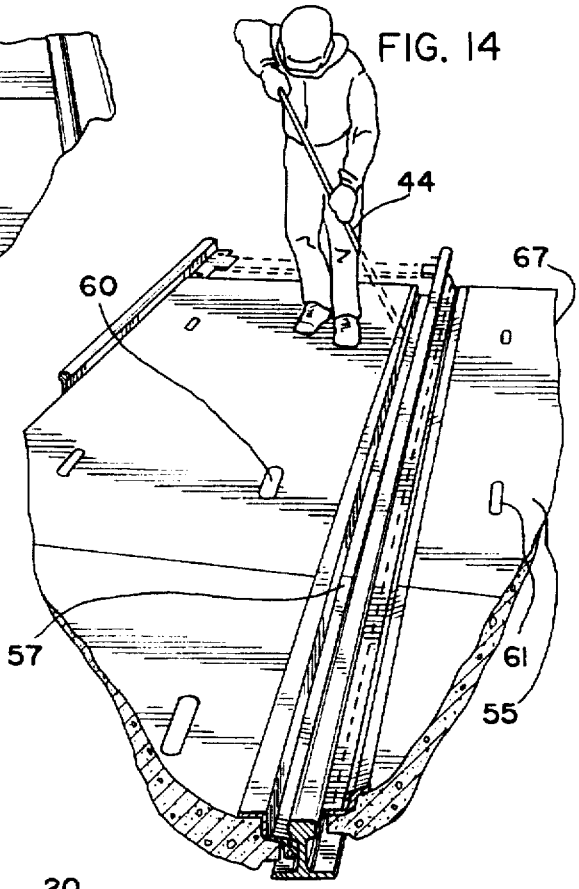
FIG. 14 is a view similar to FIG. 13 but showing a railroad worker equipped with a pinch-bar in the process of moving the extrusion into its sealed condition as illustrated in FIG. 6.

In FIG. 9, a panel 29 is seen in the process of being installed between rails 20. For this purpose, a crane (not shown) or other piece of construction equipment is equipped with chains 58 and hooks 59 which engage lifting devices 60 provided as part of the panel 29—see, for example, the showing in U.S. Pat. No. 5,181,657. The transverse dimension of the panel 29 is slightly less than the spacing of the rail balls so that the panel 29 is readily deposited on the ties 27. Any number of panels 29 can be centered between the rails 20—depending on the width of the roadway, and these are butted together. The panels are advantageously spot welded in the areas of the transverse members 51 to form a dead weight mass which effectively resists shifting parallel to the rails. Still further, angle clips as at 61 in FIG. 12 may be installed to prevent any longitudinal shifting. Either before or after the installation of the steps 61, the extrusions 30 are installed as seen in FIGS. 13 and 14. More particularly, the extrusion is laid down on the projection upper surface 41 and with the foot 33 abutting the upper side surface 54 of the panel 29. Thereafter, the clamping bar 36 is installed over the butt segments 37 and nuts 38 installed and tightened to clamp the foot 33 in place as seen in FIG. 2.

The position of the extrusion in FIG. 13 is that also illustrated in FIG. 2. The unstressed extrusion is supported on the upper surface 42 of the projections 39—compare FIGS. 12 and 13. Sections of extrusion, as needed, are laid end to end and joined with adhesive patches 57—see both FIGS. 13 and 14. A variety of materials equipped with pressure sensitive adhesive can be used for this purpose—as, for example, tire repair patches. This also develops a watertight seal. After all sections are joined with flexible adhesive patches, the entire length can be wedged in place with the pinch bar 44 as seen in FIG. 14.

More particularly, the pinch bars is used to apply forces to the various notches 45, 47, 49 in sequence and also applying these forces at different longitudinal positions along the extrusion. These longitudinally spaced applied forces can be applied either after only a portion of the extrusion 30 has been rotated into position under the ball 24—as by inserting the pinch bar 44 into the notch 45—or after just a longitudinal segment of the extrusion 30 has been completely rotated under the ball 24 as by inserting the pinch bar sequentially into the notches 45, 47, 49 before moving on to another longitudinal position.

To complete the installation, outboard or field panels as at 55 (see FIGS. 7, 8 and 14) are installed. Again, the panels are equipped with lifting devices as at 61—see FIG. 14. This permits a crane or other piece of construction equipment to swing the panel 55 into position as depicted in FIGS. 7 and 8. Although the extrusion 30 could be interposed between the field panel 55 and the rail 20, a simpler filler or seal 62 can be employed. For example, there is no need to keep the adjacent side 63 of the ball 24 free because there is no wheel flange on that side of the rail. Thus, a simple generally L-shaped seal 62 can be employed and this effects a water-tight seat between the rail 20 and the panel 55. More particularly, the panel 55 is also equipped with a perimeter angle frame as at 64 as well as the projection 56. So the seal 63, in the illustration given, is supported on its outboard side against the angle frame 64 and the upper surface 65 of the projection 56. On its inboard side, it contacts the side surface 63 of the ball 24 as well as the outboard under surface 66 of the ball 24.

As can be appreciated from a consideration of FIG. 14, the field panel 55 has an outboard edge surface 67 which is square, i.e., lacking the projection 56 which is provided on the inboard side of the panel 55. Normally, the material of the roadway, viz., asphalt, comes right up to the edge surface 67 to make a smooth transition between the roadway and the crossing installation.

Maintenance

From time to time, it is necessary to remove crossing installations for sub-surface maintenance. In many cases, ties or ballast have to be renewed or repaired and to gain access, it is necessary to remove the panels. With the invention, it is a simple procedure to break the spot-welds between panels 29 or 55, as the case may be. After this, a crane or other construction equipment hooks into the built-in and lifting devices 60 or 61. Then, lifting slightly higher on one longitudinally extending side of the panel, the panel is shifted transversely under the ball of one rail until the coaction of the web or bight 22 and projection surface 43 compresses the extrusion sufficiently on the one rail side to permit easy removal of the seal on the other side. This is accomplished simply by removing the nuts 38 from the bolt segments 37 and thereafter removing the clamping bar 36.

Should the extrusion seal be damaged to the extent that is could not be reused, another new section of rubber seal can be bolted on with relatively little effort. With the simplicity and ruggedness of the extrusion, spare seals and splicing patches can be maintained on hand in the field as maintenance items.

A number of advantages stem from the invention, as follows:

Displace Rubber With Concrete: Although concrete panels have been used in combination with elastomeric seals, there has been a reluctance on the part of railroads to depart from total rubber installations and thereby sacrifice the integrity of the seal against water and debris penetration. Here, concrete panels fit snugly between rails with a unique profile so that thin, flexible extruded rubber in a generally P-shape can become an integral part of the concrete panels (both the gauge and field panels) which will then form a seal under the ball of the rail when installed. The rubber is of thin wall but relatively height durometer of the order of about 60.

Unique Rubber Seal: The thin-walled rubber extrusion makes use of a "spring action" of the material to return to its original shape after being compressed under the ball of the rail with a pinch bar. The upward thrust of the rubber against the underside of the ball of the rail forms a seal that prevents water and debris from getting down into the ballast. This seal, in combination with the off-set projection construction, forms a trough to carry water and debris to the end of the crossing. As can be appreciated from a consideration of FIG. 2, for example, the height of the panel 29 is approximately that of the rail 20. With both resting on the tie 27, this insures that there is a plane over which vehicular traffic moves with a minimum of obstruction or bumps. The height (or depth) of the projection 39 at its base is approximately 50% of the height of the panel 29 with the height of the upper and lower portions (as represented by the sidewalls 54 and 40, respectively) of the panel 29. The slope of the upper surface 42 of the projection 39 is of the order of 15° but this may be varied depending upon various design factors including strength of material, etc. Normally, the angle (again with the horizontal) formed by the lower wall 68 is also advantageously of the order of about 15°. Some variation is possible here, again depending upon various design considerations and the accommodation of the projection of the base 21.

A further advantage of the invention is illustrated in FIGS. 15 and 16. Where there is the possibility of an ice buildup as illustrated at I in FIG. 15, the entry of the wheel flange W (see FIG. 16) can break up the accumulated ice. Because of the inherent resiliency of the extrusion 30, there is a tendency of the tail part 32 to move upwardly as illustrated in FIG. 15. This creates and air space between the tail part 32 and the upper wall 42 of the projection 39. This air space A is then reduced by the action of the wheel flange W as illustrated in FIG. 16—and without applying any substantial force to the projection 39.

Steel Frame: The angle iron frame 35, 64 serves to protect vulnerable concrete edges from damages from vehicular traffic. Although this is known, the invention goes further by virtue of interrupting the transverse portions of the frame to prevent undesirable short-circuiting of electric current from one rail to the other. Likewise, fiberglass (non-conducting) reinforcing bars are used in the transverse direction of the gauge panels.

Preassembly: The invention makes possible the advantageous preassembly of parts at the manufacturing site for convenient and compact packaging for transportation to the crossing installation site. Normally, at least two or more gauge panels 29 are required for a crossing—with each panel having advantageously a ten foot length. The panels can be equipped with the extrusions 30 and the stepped clamping bars 36. In some instances, it is further advantageous to make use of the releasable means 137 shown in FIGS. 17 and 18. Instead of having a threaded assembly as seen in FIG. 2 and consisting of the bolt or stud 37 and nut 38, I make use of a headed stud 137 and where the head is designated 138. This avoids any possible difficulty in installation (or reinstallation) due the threads becoming corroded by exposure to weather. The stud 137, like the bolt 37 is advantageously welded to the angle iron 135 and the clamping bar 136 is advantageously equipped with a keyhole shaped opening 169. The advantage of either the threaded assembly or the slidable assembly seen in FIGS. 17 and 18 is that convenient preassembly is made possible at the site of manufacture.

While in the foregoing specification a detailed description of an embodiment of the invention has been set down for the purpose of illustration, many variations in the details hereingiven may be made by those skilled in the art without departing from the spirit and scope of the invention.

I claim:

1. A railway crossing installation comprising:

a pair of spaced apart elongated rails each having in transverse section a bottom horizontal flange, a vertically extending bight and a top ball with said ball having an upper surface and lower surface flanking said bight, at least one relatively elongated concrete panel with each panel having a top surface generally aligned with said ball upper surface, each panel having elongated sides disposed adjacent said rails and ends disposed in confronting relation to any adjacent panels, said panel side adjacent a rail having an elongated projection spaced below said panel top surface, said projection extending toward said bight and having a vertical side spaced from said bight, a resilient, elongated extrusion extending along each panel side between said projection side and said rail bight, said extrusion having a body part compressively stressed between a respective ball lower surface and a respective projection side, said body part when unstressed overlying said projection, said extrusion also having a tail part integral with said body part, said tail part being secured to a respective panel side and said body part overlying said tail part when said body part is unstressed, said body part being equipped with opening means extending therethrough for at least partial collapse when said body part is compressively stressed, and said at least partial collapse of said opening means is essentially independent of a railroad wheel passing over said extrusion.

2. A railway crossing installation comprising:

a pair of spaced apart elongated rails each having in transverse section a bottom horizontal flange, a vertically extending bight and a top ball with said ball having an upper surface and lower surface flanking said bight, at least one relatively elongated concrete panel with each panel having a top surface generally aligned with said ball upper surface, each panel having elongated sides disposed adjacent said rails and ends disposed in confronting relation to any adjacent panels, said panel side adjacent a rail having an elongated projection spaced below said panel top surface, said projection extending toward said bight and having a vertical side spaced from said bight, a resilient, elongated extrusion extending along each panel side between said projection side and said rail bight, said extrusion having a body part compressively stressed between a respective ball lower surface and a respective projection side, said body part when unstressed overlying said projection, said extrusion also having a tail part integral with said body part, said tail part being secured to a respective panel side and said body part overlying said tail part when said body part is unstressed, said body part being equipped with opening means extending therethrough for at least partial collapse when said body part is compressively stressed, and said extrusion is generally P-shaped when said body part is compressively stressed with said body part constituting the loop of the P shape and the tail part constituting the stroke of the P shape.

3. The installation of claim 2 in which said opening means includes a first opening adjacent the stroke of said P and a second opening remote from said P stroke.

4. The installation of claim 3 in which said first opening is smaller in area than said second opening.

5. A railway crossing installation comprising:

a pair of spaced apart elongated rails each having in transverse section a bottom horizontal flange, a vertically extending bight and a top ball with said ball having an upper surface and lower surface flanking said bight, at least one relatively elongated concrete panel with each panel having a top surface generally aligned with said ball upper surface, each panel having elongated sides disposed adjacent said rails and ends disposed in confronting relation to any adjacent panels, said panel side adjacent a rail having an elongated projection spaced below said panel top surface, said projection extending toward said bight and having a vertical side spaced from said bight, a resilient, elongated extrusion extending along each panel side between said projection side and said rail bight, said extrusion having a body part compressively stressed between a respective ball lower surface and a respective projection side, said body part when unstressed overlying said projection, and said extrusion body part is equipped with a plurality of notch means to enable force to be applied to position said body part under a respective rail ball.

6. The installation of claim 5 in which said body part has a generally oval shape in side elevation, said notch means extending transversely of the extrusion length.

7. The installation of claim 6 in which each notch means includes a step surface adapted to receive the end of a pinch bar.

8. The installation of claim 7 in which said notch means are spaced about said body part with said notch means on opposite sides of said body part adjacent said tail part.

9. A railway crossing installation comprising:

a pair of spaced apart elongated rails each having in transverse section a bottom horizontal flange, a vertically extending bight and a top ball with said ball having an upper surface and lower surface flanking said bight, at least one relatively elongated concrete panel with each panel having a top surface generally aligned with said ball upper surface, each panel having elongated sides disposed adjacent said rails and ends disposed in confronting relation to may adjacent panels, said panel side adjacent a rail having an elongated projection spaced below said panel top surface, said projection extending toward said bight and having a vertical side spaced from said bight, a resilient, elongated extrusion extending along each panel side between said projection side and said rail bight, said extrusion having a body part compressively stressed between a respective ball lower surface and a respective projection side, said body part when unstressed overlying said projection, and each concrete panel being generally rectangular and equipped with a perimetric metal frame, said frame having interrupted portions to prevent current from flowing from one rail to another.

10. The installation of claim 9 in which said frame is constructed of angle steel with two transverse members connected by two longitudinal members, said interrupted portions being located in said transverse members.

11. The installation of claim 10 in which plastic block means are mounted on said panels in said interrupted portions.

12. The installation of claim 10 in which at least one of said longitudinal members is equipped with threaded means for securing said extrusion.

13. The installation of claim 9 in which said panel is equipped with transversely-extending reinforcing bars constructed of a material having a relatively high resistance to current flow.

14. The installation of claim 13 in which said reinforcing bars are constructed of fiber glass.

15. A railway crossing installation comprising:

a pair of spaced apart elongated rails each having in transverse section a bottom horizontal flange, a vertically extending bight and a top ball with said ball having an upper surface and lower surface flanking said bight, at least one relatively elongated concrete panel with each panel having a top surface generally aligned with said ball upper surface, each panel having elongated sides disposed adjacent said rails and ends disposed in confronting relation to any adjacent panels, said panel side adjacent a rail having an integral elongated protection spaced below said panel tops surface, said projection extending toward said bight and having a vertical side spaced from said bight, and a resilient, elongated extrusion extending along each panel side between said projection side and said rail bight, said extrusion having a body part compressively stressed between a respective rail surface and a projection side, said body part when unstressed overlying said projection, said body part being equipped with transversely extending opening means which are at least partially collapsed when said body part is installed between said projection and rail, said extrusion body part is equipped with a plurality of notch means to enable force to be applied to position said body part under a respective rail ball, said notch means extending generally transversely and having a step engageable by a pinch bar for forcing said body part into compressively stressed condition.

16. A railway crossing installation comprising:

a pair of spaced apart elongated rails each having in transverse section a bottom horizontal flange, a vertically extending bight and a top ball with said ball having an upper surface and lower surface flanking said bight, at least one relatively elongated concrete panel with each panel having a top surface generally aligned with said ball upper surface, each panel having elongated sides disposed adjacent said rails and ends disposed in confronting relation to any adjacent panels, said panel side adjacent a rail having an integral elongated projection spaced below said panel top surface, said projection extending toward said bight and having a vertical side spaced from said bight, and a resilient, elongated extrusion extending along each panel side between said projection side and said rail bight, said extrusion having a body part compressively stressed between a respective rail surface and a projection side, said body part when unstressed overlying said projection, said body part being equipped with transversely extending notch means to enable force to be applied to position said body part under a respective rail ball.

17. The installation of claim 16 in which said body part is equipped with transversely extending opening means which are at least partially collapsed when said body part is installed between said projection and rail.

18. A railway crossing installation comprising:

a pair of spaced apart elongated rails each having in transverse section a bottom horizontal flange, a vertically extending bight and a top ball with said ball having an upper surface and lower surface flanking said bight, at least one relatively elongated concrete panel with each panel having a top surface generally aligned with said ball upper surface, each panel having elongated sides disposed adjacent said rails and ends disposed in confronting relation to any adjacent panels, said panel side adjacent a rail having an integral elongated projection spaced below said panel top surface, said projection extending toward said bight and having a vertical side spaced from said bight, and a resilient, elongated extrusion extending along each panel side between said projection side and said rail bight, said extrusion having a body part compressively stressed between a respective rail surface and a projection side, said body part when unstressed overlying said projection, said body part being equipped with transversely extending opening means which are at least partly collapsed when said body part is stressed, said body part being equipped with notch means for converting said extrusion from unstressed to stressed conditions.

* * * * *